US007404303B1

(12) United States Patent
Barbosa et al.

(10) Patent No.: US 7,404,303 B1
(45) Date of Patent: Jul. 29, 2008

(54) AUTOMATIC DROP WASHER/DRYER

(76) Inventors: Domingos D. Barbosa, 1870 Park St., Hartford, CT (US) 06106; Maria F. Barbosa, 1870 Park St., Hartford, CT (US) 06106

( * ) Notice: Subject to any disclaimer, the term of this patent is extended or adjusted under 35 U.S.C. 154(b) by 268 days.

(21) Appl. No.: 11/274,224

(22) Filed: Nov. 14, 2005

(51) Int. Cl.
*D06F 25/00* (2006.01)

(52) U.S. Cl. ..... 68/3 R; 68/19.2; 68/20

(58) Field of Classification Search ..... 68/19.2, 68/20, 3 R

See application file for complete search history.

(56) References Cited

U.S. PATENT DOCUMENTS 1,720,961 A * 7/1929 Lindberg ..... 68/139
2,029,117 A * 1/1936 Otis ..... 34/222
2,165,487 A * 7/1939 Johnson ..... 68/18 C
2,467,093 A * 4/1949 Page et al. ..... 414/303
2,566,488 A * 9/1951 Gould ..... 68/20
2,816,429 A * 12/1957 Kurlancheek ..... 68/19.2
2,834,121 A * 5/1958 Peter ..... 34/75
2,866,273 A * 12/1958 Peter ..... 34/75
3,139,744 A * 7/1964 Van Alstyne et al. ..... 68/20
3,220,229 A * 11/1965 Livesay ..... 68/19.2
3,479,222 A * 11/1969 David et al. ..... 134/33
3,545,235 A * 12/1970 Menk ..... 68/19.2
3,788,004 A * 1/1974 Billeri et al. ..... 49/41
5,378,036 A * 1/1995 Townsend ..... 296/155
6,671,978 B1 * 1/2004 McGowan et al. ..... 34/596
6,978,556 B1 * 12/2005 Cornelious ..... 34/596

FOREIGN PATENT DOCUMENTS

DE 24 51 339 * 4/1976
KR 2001054710 * 7/2001

OTHER PUBLICATIONS

European Patent Office 747 523 Dec. 1996.*
European Patent Office 1 369 523 May 2003.*

* cited by examiner

*Primary Examiner*—Frankie L Stinson

(57) ABSTRACT

An automatic drop washer/dryer is disclosed. The automatic drop washer/dryer includes a dryer unit, a washer unit provided above the dryer unit and at least one gate provided between the dryer unit and the washer unit for closing the dryer unit from the washer unit during a washing cycle and allowing clothing to drop from the washer unit and into the dryer unit after the washing cycle.

12 Claims, 7 Drawing Sheets

AUTOMATIC DROP WASHER/DRYER

FIELD OF THE INVENTION

The present invention relates to clothes washers and dryers. More particularly, the present invention relates to an automatic drop washer/dryer which includes a washer unit on top of a dryer unit and automatically transfers washed clothes from the washer to the dryer by gravity.

BACKGROUND OF THE INVENTION

Conventional clothes washers include a washer unit and a dryer unit which are physically separate from each other. Soiled clothing is initially washed in the washer unit, then manually transferred to the dryer unit and dried. However, much time and effort may be expended in transferring wet clothes from the washer unit to the dryer unit. Therefore, an automatic drop washer/dryer is needed which is capable of washing clothes and then dropping the clothes into the dryer for drying of the clothes.

SUMMARY OF THE INVENTION

The present invention is generally directed to an automatic drop washer/dryer. The automatic drop washer/dryer includes a dryer unit, a washer unit provided above the dryer unit and at least one gate provided between the dryer unit and the washer unit for closing the dryer unit from the washer unit during a washing cycle and allowing clothing to drop from the washer unit and into the dryer unit after the washing cycle.

BRIEF DESCRIPTION OF THE DRAWINGS

The invention will now be described, by way of example, with reference to the accompanying drawings, in which.

DETAILED DESCRIPTION OF THE INVENTION

Figure 1:
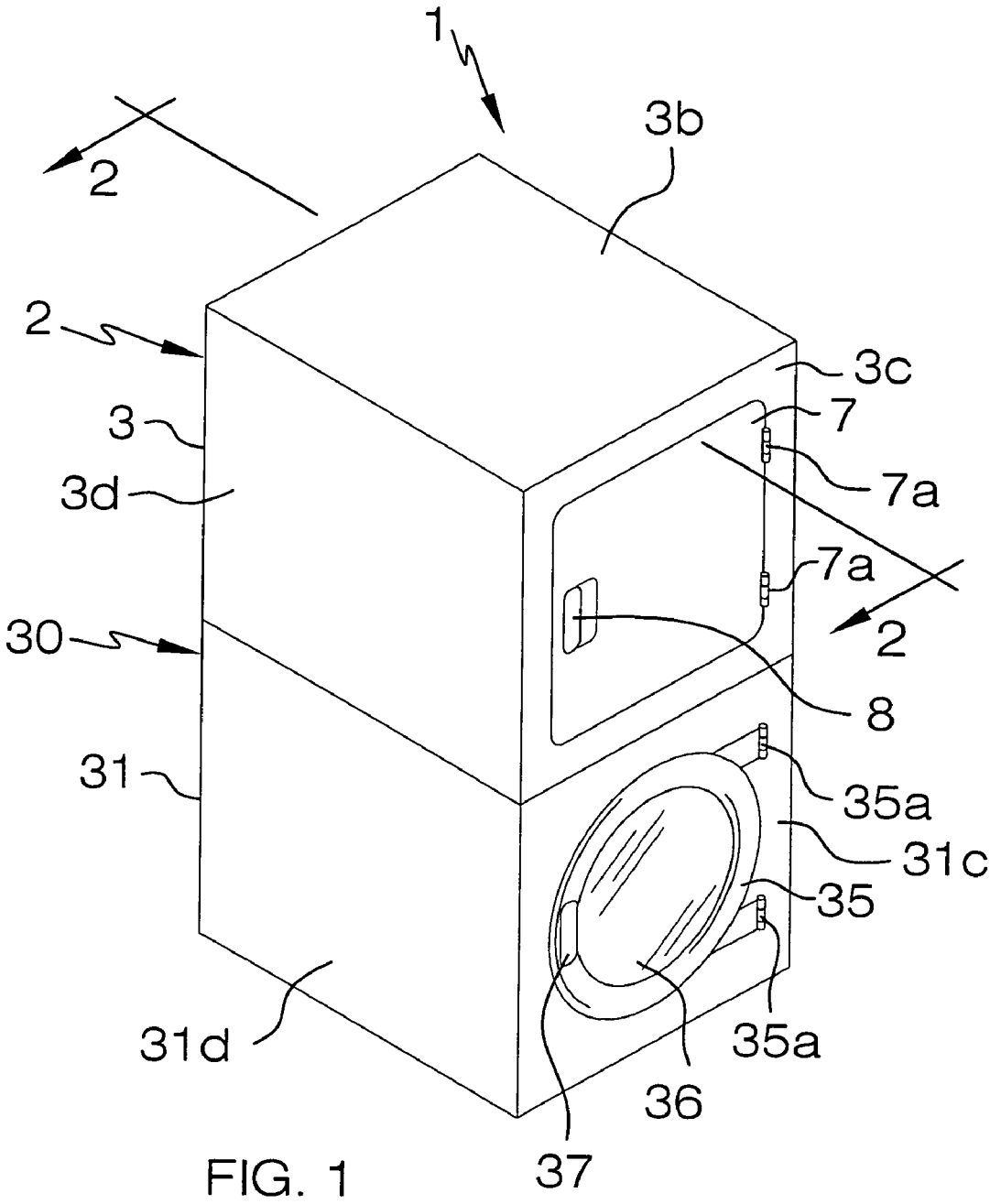
FIG. 1 is a front perspective view of an illustrative embodiment of the automatic drop washer/dryer according to the present invention.
Figure 2:
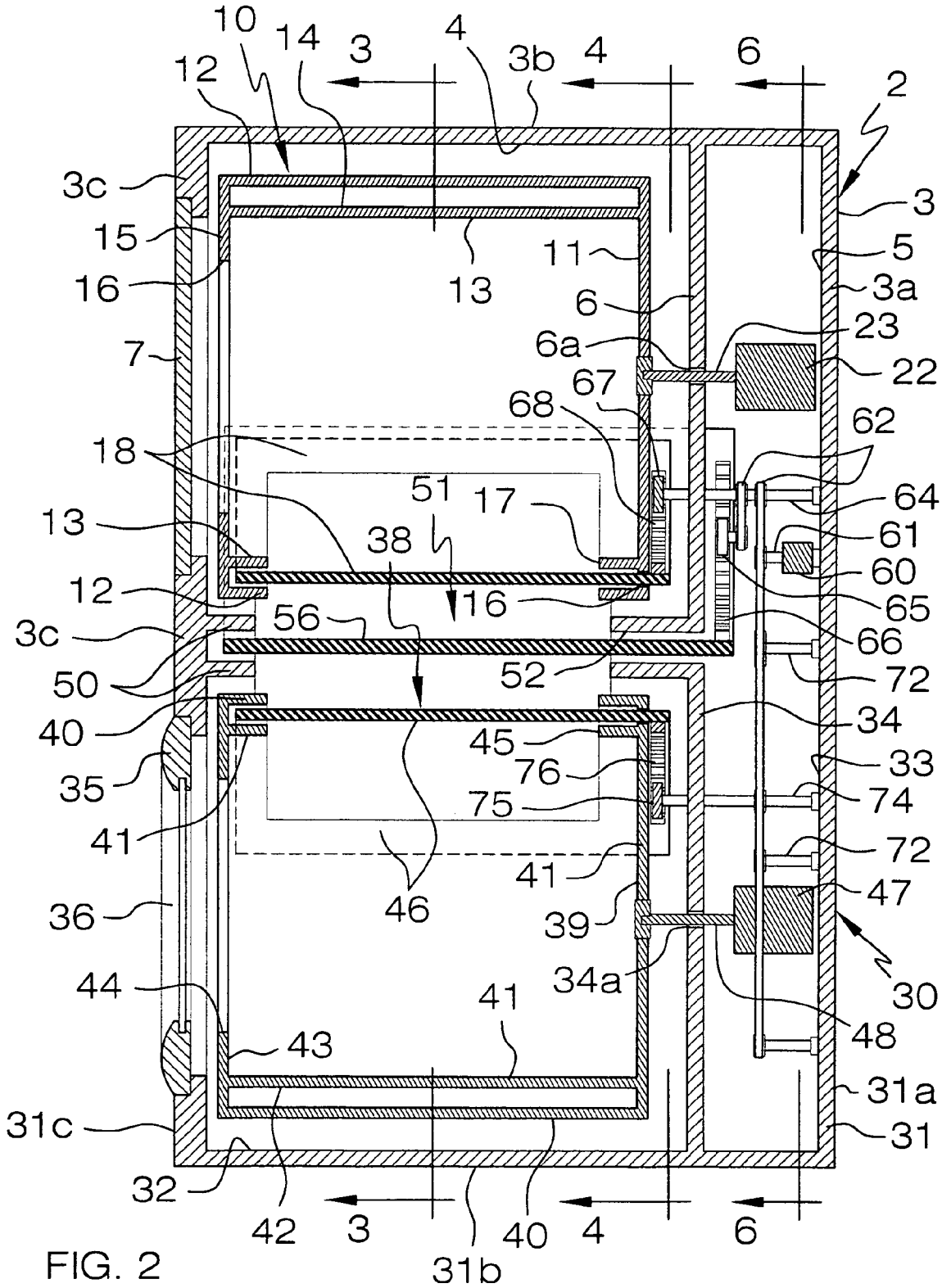
FIG. 2 is a sectional view, taken along section lines 2-2 in FIG. 1.

Referring to the drawings, an illustrative embodiment of the automatic drop washer/dryer according to the present invention is generally indicated by reference numeral 1. As shown in FIG. 1, the automatic drop washer/dryer 1 includes a washer unit 2 which is provided on top of a dryer unit 30. The washer unit 2 includes a washer cabinet 3 having a rear wall 3*a*, a top wall 3*b* and a front wall 3*c*, as shown in FIG. 2, and side walls 3*d*, as shown in FIG. 1. Likewise, the dryer unit 30 typically includes a dryer cabinet 31 which may be continuous with the washer cabinet 3. The dryer cabinet 31 typically includes a rear wall 31*a*, a bottom wall 31*b* and a front wall 31*c*, as shown in FIG. 2, and side walls 31*d*, as shown in FIG. 1.

As shown in FIG. 2, the washer unit 2 includes a drum compartment 4 which occupies the front of the washer cabinet 3 and a motor compartment 5 which occupies the rear of the washer cabinet 3. A partition 6 separates the drum compartment 4 from the motor compartment 5. A washer door 7, fitted with a handle 8, is pivotally attached to the front wall 3*c* of the washer cabinet 3 via hinges 7*a* and reversibly seals a washer opening (not shown).

Figure 3:
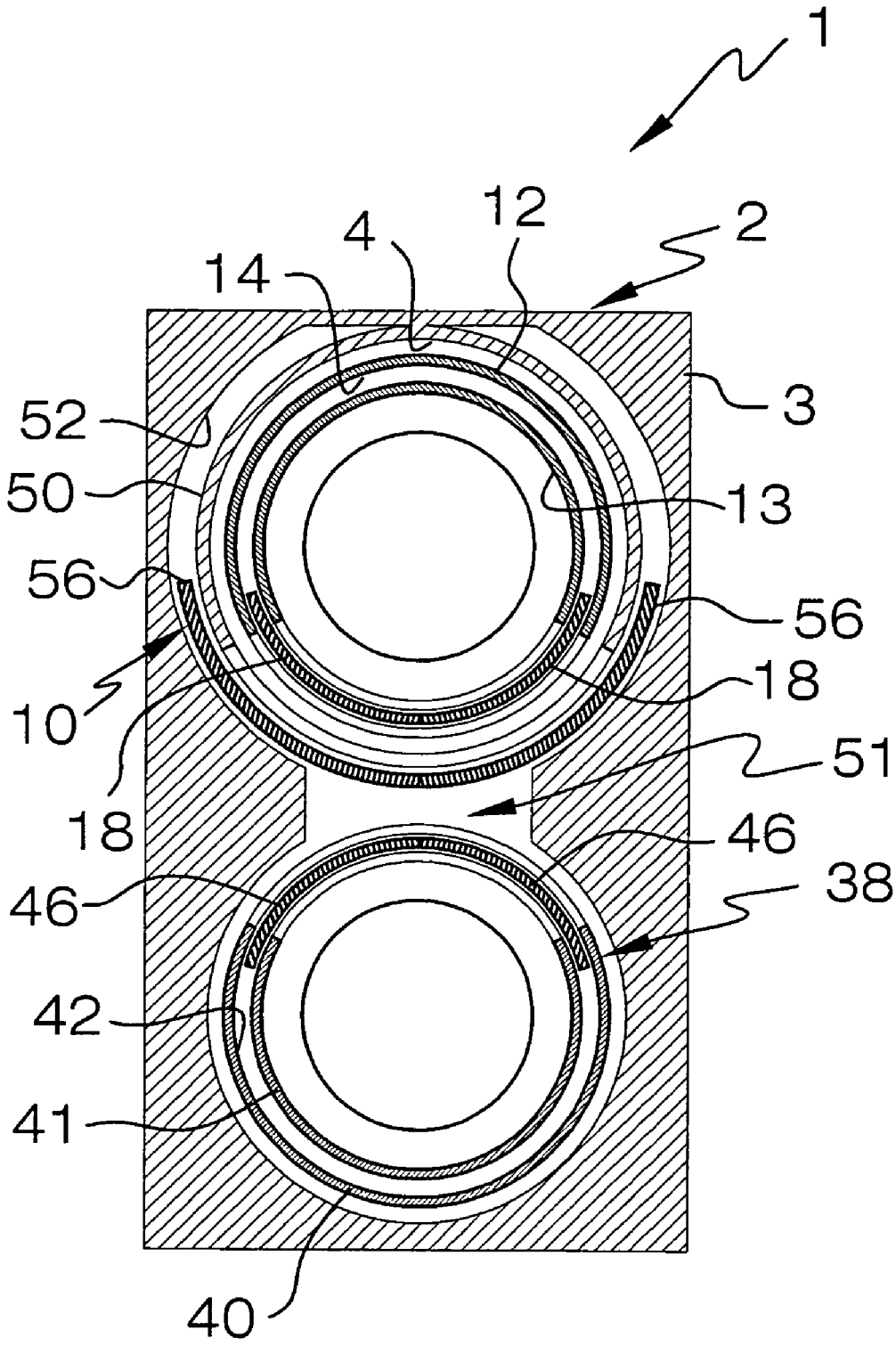
FIG. 3 is a sectional view, taken along section lines 3-3 in FIG. 2.

A generally cylindrical washer drum 10 is rotatably mounted in the drum compartment 4 of the washer cabinet 3. The washer drum 10 typically includes a rear wall 11 which is disposed adjacent to the partition 6; an outer wall 12 extending from the rear wall 11; an inner wall 13 which extends from the rear wall 11, in spaced-apart relationship to the outer wall 12; and a gate space 14 between the outer wall 12 and the inner wall 13. A front wall 15 extends from the outer wall 12 and the inner wall 13. A drum opening 16, which is disposed adjacent to the washer door 7, extends through the front wall 15. A gate opening 17 extends through both the outer wall 12 and the inner wall 13. As shown in FIG. 3, a pair of generally arcuate, adjacent washer gates 18 (one of which is shown in FIG. 2) is slidably mounted in the gate space 14. When the washer gates 18 engage each other, as shown in FIG. 3, a water-tight seal (not shown) is provided between the washer gates 18.

As further shown in FIG. 2, a washer motor 22 is provided on the rear wall 3*a* of the washer cabinet 3, inside the motor compartment 5. A motor shaft 23 is drivingly engaged by the washer motor 22 and extends through a shaft opening 6*a* provided in the partition 6 and engages the rear wall 11 of the washer drum 10 to rotate the washer drum 10 in the drum compartment 4. Although not shown in the drawings, the drum compartment 4 is fitted with water spraying and draining features which may be conventional and are appropriate to facilitate the application of water to clothing (not shown) contained in the washer drum 10 as well as the drainage of water from the washer drum 10 during operation of the automatic drop washer/dryer 1, which will be hereinafter described.

A drum compartment 32 is provided in the front portion of the dryer cabinet 31, and a motor compartment 33 is provided in the rear portion of the dryer cabinet 31. A partition 34 separates the drum compartment 32 from the motor compartment 33. A generally cylindrical dryer drum 38 is rotatably mounted in the motor compartment 33. The dryer drum 38 typically includes a rear wall 39 which is disposed adjacent to the partition 34; an outer wall 40 which extends from the rear wall 39; an inner wall 41 which extends from the rear wall 39, in spaced-apart relationship to the outer wall 40; and a door space 42 between the outer wall 40 and the inner wall 41. A front wall 43 extends from the outer wall 40 and the inner wall 41, and a drum opening 44 extends through the front wall 43. A door opening 45 extends through both the outer wall 40 and the inner wall 41. As shown in FIG. 3, a pair of generally arcuate dryer gates 46 (one of which is shown in FIG. 2) is slidably mounted in the door space 42. When the dryer gates 46 engage each other, as shown in FIG. 3, a water-tight seal (not shown) is provided between the dryer gates 46. A dryer door 35, which may be fitted with a window 36 and a door handle 37, is pivotally mounted on the front wall 31*c* of the dryer cabinet 31 via hinges 35*a*.

As further shown in FIG. 2, a dryer motor 47 is provided on the rear wall 31*a* of the dryer cabinet 31, inside the motor compartment 33. A motor shaft 48 is drivingly engaged by the dryer motor 47 and extends through a shaft opening 34*a* provided in the partition 34 and engages the rear wall 39 of the dryer drum 38 to rotate the dryer drum 38 in the drum compartment 32. Although not shown in the drawings, the drum compartment 32 is fitted with air heating and blowing features which may be conventional and are appropriate to facilitate the application of heated air to clothing (not shown) contained in the dryer drum 38 as well as the evacuation of moisture from the dryer drum 38 during operation of the automatic drop washer/dryer 1, which will be hereinafter described.

As shown in FIG. 3, a pair of dividing walls 50 extends between the front wall 3*c* of the washer cabinet 3 and the partition 6 and the front wall 3*c* and the partition 34. A gate space 52 is defined between the dividing walls 50, and a drop slot 51 extends through the dividing walls 50. As shown in FIG. 3, a pair of generally arcuate main gates 56 (one of which is shown in FIG. 2) is slidably mounted in the gate space 52. When the main gates 56 engage each other, as shown in FIG. 3, a water-tight seal (not shown) is provided between the main gates 56.

Figure 5:
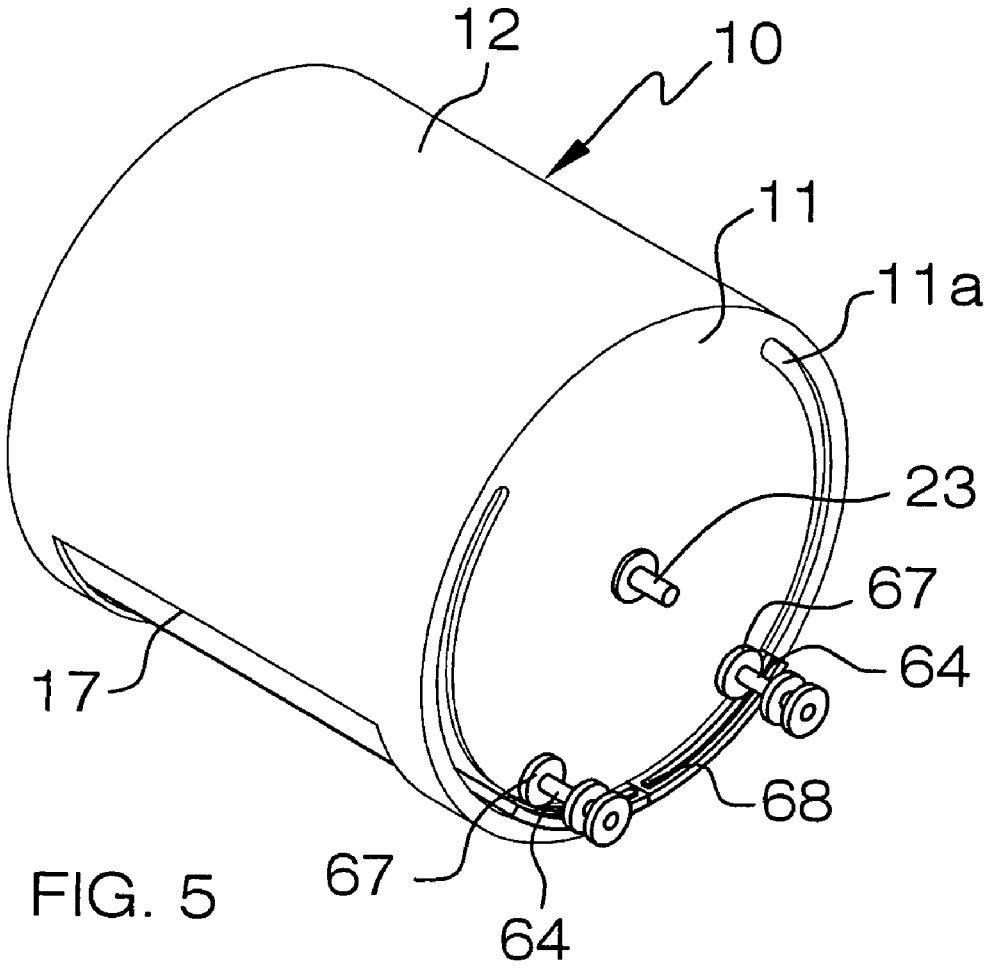
FIG. 5 is a rear perspective view of a washer drum element of the automatic drop washer/dryer according to the present invention.
Figure 6:
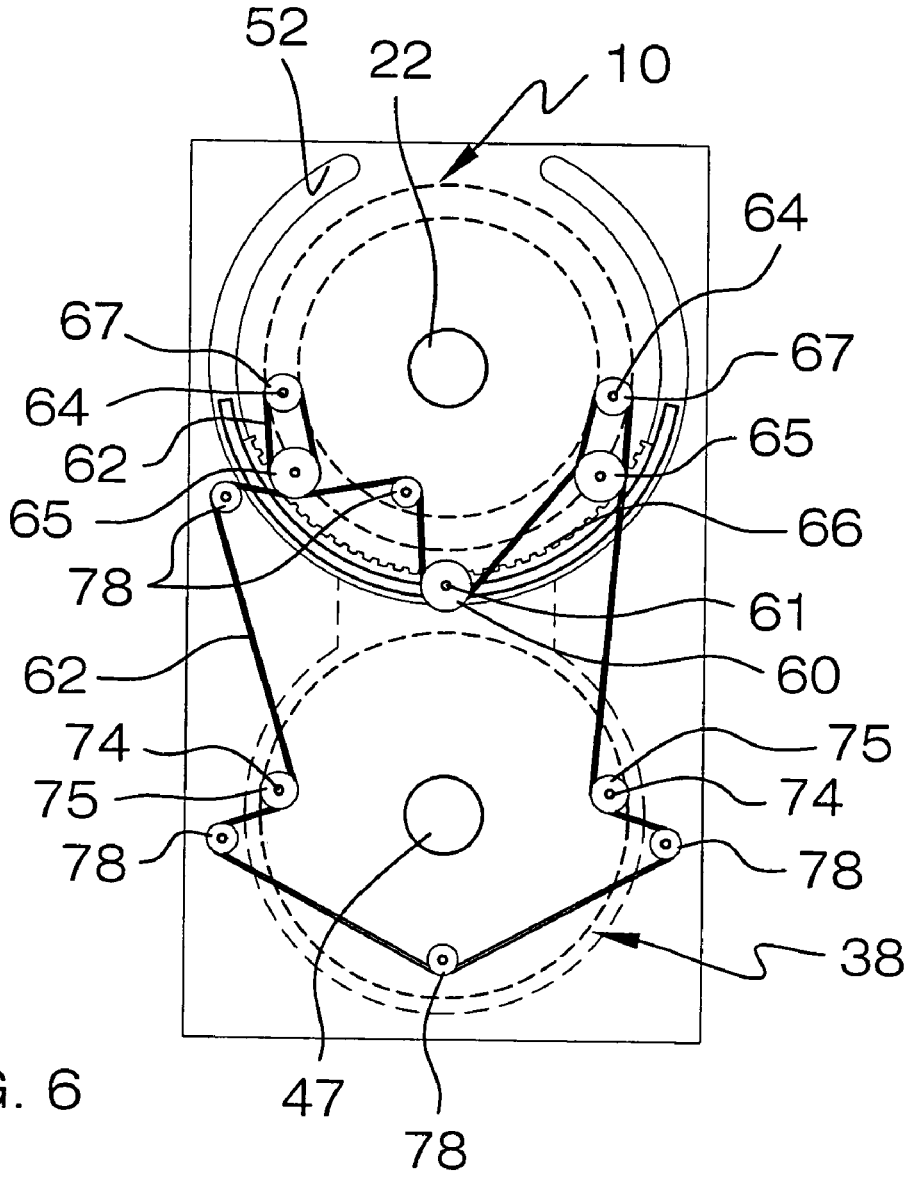
FIG. 6 is a schematic view illustrating a typical belt and pulley system for facilitating the automatic transfer of washed clothing from the washer unit to the dryer unit of the automatic drop washer/dryer according to the present invention.

As shown in FIGS. 2 and 6, a gate drive motor 60 is provided on the washer cabinet 3, inside the motor compartment 5 of the washer cabinet 3 or the motor compartment 33 of the dryer cabinet 31. A motor shaft 61 is drivingly engaged by the gate drive motor 60. A pair of shafts 64 (one of which is shown) further extends from the rear wall 3*a*, through the partition 6 and further through an arcuate slot 11*a* provided in the rear wall 11 of the washer drum 10, as shown in FIG. 5. Each shaft 64 engages a corresponding main gate pinion 65 through a drive belt 62. A generally arcuate main gate rack 66 is provided on each main gate 56 and meshes with the corresponding main gate pinion 65. A washer gate pinion 67 is provided on each shaft 64 and, in similar fashion, meshes with a generally arcuate dryer gate rack 68 which is provided on the corresponding washer gate 18.

Figure 4:
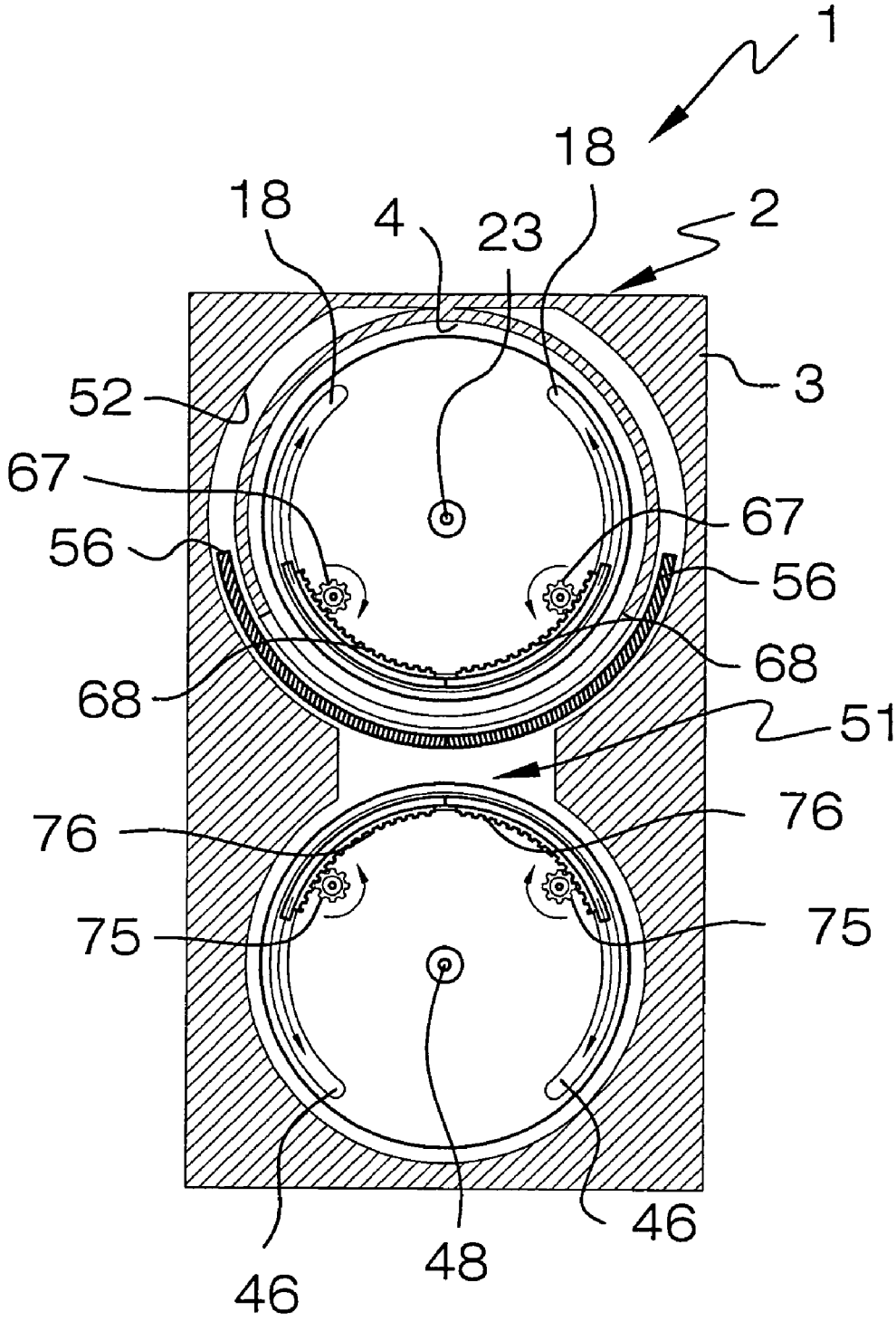
FIG. 4 is a sectional view, taken along section lines 4-4 in FIG. 2.

A pair of shafts 74 (one of which is shown in FIG. 2) extends from the rear wall 31*a* of the dryer cabinet 31, into the motor compartment 33 and through the partition 34. The drive belt 62 may be trained around a system of pulleys 78, as shown in FIG. 6, each provided on an idle shaft 72 which extends from the rear wall 3*a* and the rear wall 31*a*, as shown in FIG. 2, and engages each shaft 74 for rotation of each shaft 74. A dryer gate pinion 75 is provided on each shaft 74. A generally arcuate dryer gate rack 76 is provided on each dryer gate 46 and meshes with each corresponding dryer gate pinion 75. Accordingly, by operation of the gate drive motor 60, the washer gate pinions 67 rotate the respective washer gates 18 between the closed, sealing position shown in FIG. 3 and the open position shown in FIG. 4. Likewise, by operation of the gate drive motor 60, the dryer gate pinions 75 rotate the respective dryer gates 46 between the closed position of FIG. 3 and the open position of FIG. 4 and the main gate pinions 65 rotate the respective main gates 56 between the closed position of FIG. 3 and the open position of FIG. 4.

Figure 7:
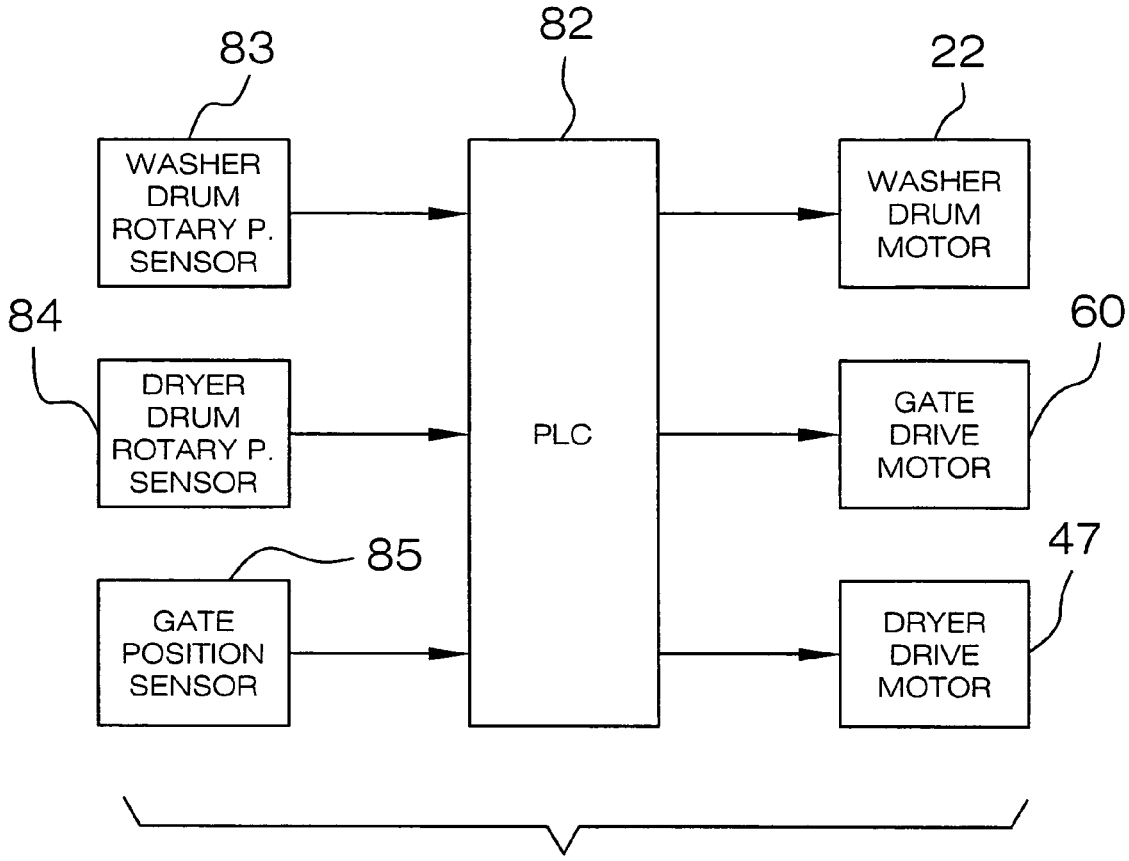
FIG. 7 is a schematic diagram illustrating typical operation of the automatic drop washer/dryer.

Referring next to FIG. 7, a washer drum rotary sensor 83, a dryer drum rotary sensor 84 and a gate position sensor 85 are connected to a PLC (programmable logic controller) 82. The washer drum rotary sensor 83, the dryer drum rotary sensor 84 and the gate position sensor 85 are positioned in such locations to sense rotation of the washer drum 10, rotation of the dryer drum 38 and the opened and closed positions of the washer gate 18, the dryer gate 46 and the main gate 56, respectively. Accordingly, the PLC 82 is programmed to actuate the washer drum motor 22 to commence a washing cycle of the automatic drop washer/dryer 1; stop the washer drum motor 22 and actuate the gate drive motor 60 to open the washer gates 18, the dryer gates 46 and the main gate 56 upon termination of the washing cycle; actuate the gate drive motor 60 to close the washer gates 18, the dryer gates 46 and the main gate 56 prior to commencement of the drying cycle; and actuate the dryer drive motor 47 to commence a drying cycle of the automatic drop washer/dryer 1.

In typical operation of the automatic drop washer/dryer 1, soiled clothing or the like (not shown) is initially placed in the washer drum 10 by opening the washer door 7 and inserting the clothing through the drum opening 16. Detergent (not shown) is typically placed in the washer drum 10 with the clothing. Next, the washer motor 22 rotates the washer drum 10 as a washing cycle is initiated. As the clothing tumbles in the washer drum 10, water (not shown) is sprayed into the washer drum 10 to wet the clothing and the detergent. Throughout the washing cycle, the washer gates 18, the main gates 56 and the dryer gates 46 are maintained in the closed or sealed positions shown in FIG. 2 to prevent the leakage of water from the washer drum 10 into the dryer drum 38.

After completion of the washing cycle, the water is drained from the washer drum 10 through the water drainage system (not shown). Next, the gate drive motor 60 is operated to slide the washer gates 18, the main gate 56 and the dryer gates 46 from the closed, sealed position shown in FIG. 3 to the opened position shown in FIG. 4. Consequently, the damp and washed clothing drops from the washer drum 10, through the drop slot 51 and into the dryer drum 38. Next, the gate drive motor 60 is operated in the opposite direction to return the washer gates 18, the main gate 56 and the dryer gates 46 to the closed positions shown in FIG. 3. A drying cycle is then initiated as the dryer motor 47 rotates the dryer drum 38. Simultaneously, air (not shown) is typically heated and introduced into the dryer drum 38, where the heated air dries the clothing. The resulting moisture is evacuated from the dryer drum 38 through the suitable evacuation system (not shown). After termination of the drying cycle, the washed and dried clothing is removed from the dryer drum 38 typically through the drum opening 44 and the opened dryer door 35.

While the preferred embodiments of the invention have been described above, it will be recognized and understood that various modifications can be made in the invention and the appended claims are intended to cover all such modifications which may fall within the spirit and scope of the invention.

What is claimed is:

1. An automatic drop washer/dryer comprising:

a dryer unit comprising a rotatable dryer drum having a circular inner wall, a circular outer wall and a circular gate space between said inner wall and said outer wall;

a pair of circular dryer gates slidably mounted in said circular gate space of said dryer drum;

a washer unit provided above said dryer unit and comprising a washer drum having a circular inner wall, a circular outer wall and a circular gate space between said inner wall and said outer wall; and a pair of circular washer gates slidably mounted in said circular gate space of said washer drum.

2. The automatic drop washer/dryer of claim 1 further comprising a pair of main gates provided between said pair of circular dryer gates and said pair of circular washer gates.

3. The automatic drop washer/dryer of claim 1 further comprising a gate drive motor operably engaging said pair of circular dryer gates and said pair of circular washer gates for moving said pair of circular dryer gates and said pair of circular washer gates between open and closed positions.

4. The automatic drop washer/dryer of claim 3 further comprising a pair of dryer gate pinions and a pair of washer gate pinions drivingly engaged by said gate drive motor and a pair of dryer gate racks and a pair of washer gate racks carried by said pair of circular dryer gates and said pair of circular washer gates, respectively, and meshing with said pair of dryer gate pinions and said pair of washer gate pinions, respectively.

5. The automatic drop washer/dryer of claim 4 further comprising a drive belt connecting said gate drive motor to said pair of dryer gate pinions and said pair of washer gate pinions.

6. The automatic drop washer/dryer of claim 5 further comprising a plurality of pulleys engaging said drive belt.

7. An automatic drop washer/dryer comprising:

a dryer unit comprising a rotatable dryer drum having a circular inner wall, a circular outer wall and a circular gate space between said circular inner wall and said circular outer wall;

a pair of circular dryer gates slidably mounted in said gate space of said dryer drum;

a washer unit provided above said dryer unit and comprising a circular washer drum having a circular inner wall, a circular outer wall and a circular gate space between said circular inner wall and said circular outer wall;

a pair of circular washer gates slidably mounted in said circular gate space of said washer drum;

a drop slot between said pair of circular dryer gates and said pair of circular washer gates; and a pair of main gates provided between said pair of circular dryer gates and said pair of circular washer gates for reversibly closing said drop slot.

8. The automatic drop washer/dryer of claim 7 further comprising a gate drive motor operably engaging said pair of circular dryer gates, said pair of circular washer gates and said pair of main gates for moving said pair of circular dryer gates, said pair of circular washer gates and said pair of main gates between open and closed positions.

9. The automatic drop washer/dryer of claim 8 further comprising a pair of dryer gate pinions and a pair of washer gate pinions drivingly engaged by said gate drive motor and a pair of circular dryer gate racks and a pair of circular washer gate racks carried by said pair of dryer gates and said pair of washer gates, respectively, and meshing with said pair of dryer gate pinions and said pair of washer gate pinions, respectively.

10. The automatic drop washer/dryer of claim 9 further comprising a pair of main gate pinions drivingly engaged by said gate drive motor and a pair of main gate racks carried by said pair of main gates, respectively, and meshing with said pair of main gate pinions, respectively.

11. The automatic drop washer/dryer of claim 10 further comprising a drive belt connecting said gate drive motor to said pair of dryer gate pinions, said pair of washer gate pinions and said pair of main gate pinions.

12. The automatic drop washer/dryer of claim 11 further comprising a plurality of pulleys engaging said drive belt.

* * * * *